US005530416A

United States Patent [19]

Wakamatsu et al.

[11] Patent Number: 5,530,416

[45] Date of Patent: Jun. 25, 1996

[54] INDUCTOR

[75] Inventors: Shinji Wakamatsu; Tetsuya Morinaga, both of Nagaokakyo, Japan

[73] Assignee: Murata Manufacturing Co., Ltd., Nagaokakyo, Japan

[21] Appl. No.: 354,091

[22] Filed: Dec. 6, 1994

[30] Foreign Application Priority Data

Dec. 10, 1993 [JP] Japan ..... 5-310445

[51] Int. Cl.[6] ..... H01F 15/10

[52] U.S. Cl. ..... 336/192; 336/233

[58] Field of Search ..... 336/192, 233; 335/297

[56] References Cited

U.S. PATENT DOCUMENTS 5,003,279 3/1991 Morinaga et al. ..... 336/192

5,359,311 10/1994 Kawabata et al. ..... 336/83

*Primary Examiner*—Leo P. Picard

*Assistant Examiner*—G. R. Lord

*Attorney, Agent, or Firm*—Burns, Doane, Swecker & Mathis

[57] ABSTRACT

An inductor which has a ferrite core and a coil wound around the ferrite core. The ferrite core is coated with borosilicate zinc glass. The ferrite core is produced by: adding a low-temperature-sintered oxidized metal, such as $BiO_2$ and PbO, and a resin binder to ferrite powder of Mn, Fe, Co, Ni or the like; mixing the materials together; compression molding the mixture; and sintering the molded article in a low temperature.

5 Claims, 1 Drawing Sheet

INDUCTOR

BACKGROUND OF THE INVENTION

1. Field of the Invention

The present invention relates to an inductor, and more particularly, to an inductor which has a coil wound around a ferrite core.

2. Description of Related Art

A well-known type of inductor is one which has a coil wound around a ferrite core. In order to obtain an inductor which has a low insertion loss in a high frequency band (10–1000 MHz), a ferrite core produced by low-temperature firing is generally used. However, the ferrite core produced by low-temperature firing has a small mechanical strength. For this reason, a low-temperature-sintered oxidized metal (for example, $BiO_2$ or PbO) is added to the material of the ferrite core such that the produced ferrite core can endure loads at the time of automatic insertion and other occasions.

However, when an inductor which has a ferrite core containing a low-temperature-sintered oxidized metal is soldered to a printed circuit board, the low-temperature-sintered oxidized metal is reduced by an organic acid contained in a flux used for the soldering. Thereby, the insulation resistance of the ferrite core is lowered.

SUMMARY OF THE INVENTION

An object of the present invention is to provide an inductor which has a ferrite core containing a low-temperature-sintered oxidized metal and having a good insulation resistance by inhibiting the low-temperature-sintered oxidized metal from being reduced by a flux used for soldering.

In order to attain the object, according to the present invention, an inductor has a coil wound around a ferrite core, and the ferrite core contains a low-temperature-sintered oxidized metal and has a glass coating at least on a portion which is in contact with a flux in soldering.

For example, the main constituents of the ferrite core are Ni, Zn and $Fe_2O_3$, and as the low-temperature-sintered oxidized metal, $BiO_2$ and/or PbO are added. For the glass coating, borosilicate zinc, borosilicate lead or the like is used.

The portion of the ferrite core which has the glass coating is not directly in contact with a flux in soldering. Thereby, the low-temperature-sintered oxidized metal contained in the ferrite core is inhibited from being reduced, and consequently, the lowering in the insulation resistance of the ferrite core can be prevented.

BRIEF DESCRIPTION OF THE DRAWINGS

This and other objects and features of the present invention will be apparent from the following description in connection with the accompanying drawings, in which:

FIG. 1 is a perspective view of an inductor, the upper side being a mounting side on which the inductor is mounted on a printed circuit board or the like.

DETAILED DESCRIPTION OF THE PREFERRED EMBODIMENTS

An embodiment of the present invention is described with reference to the accompanying drawings.

Figure 1:
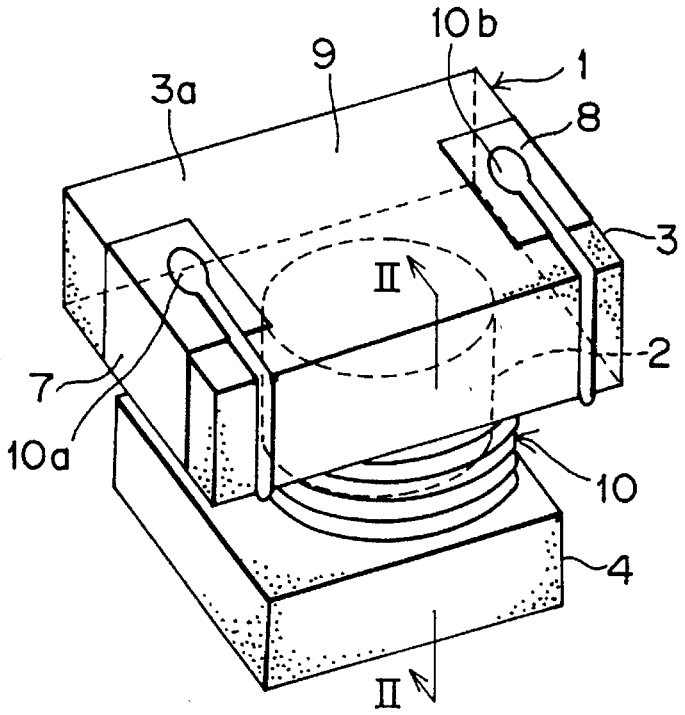
Figure 2:
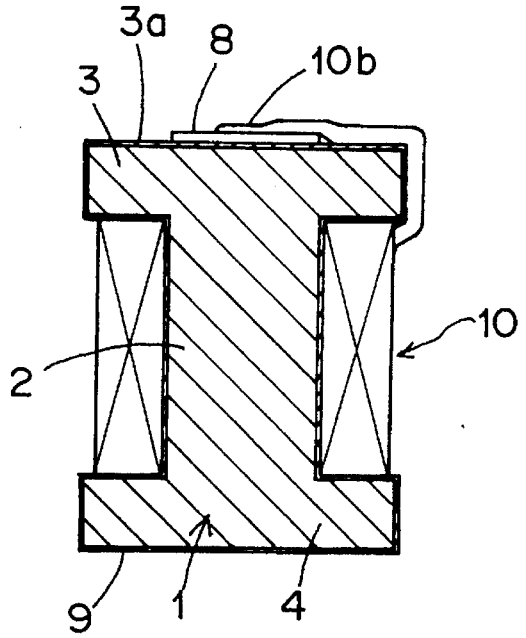
FIG. 2 is a sectional view of the inductor of FIG. 1, taken along the line II—II in FIG. 1.

FIGS. 1 and 2 show a wind type tip inductor which comprises a ferrite core 1 and a coil 10 wound around the ferrite core 1. The ferrite core 1 has a body 2 and flanges 3 and 4. The outer surface of the flange 3 is a mounting side 3*a* on which the inductor is mounted on a printed circuit board (not shown).

The ferrite core 1 is produced in the following process.

A low-temperature-sintered oxidized metal, such as $BiO_2$ or PbO, and a resin binder are added to ferrite powder of Ni—Zn—$Fe_2O_3$, and these materials are mixed together. The mixture is put in a mold and compression-molded, and the molded article is sintered in a low temperature. Next, the sintered article (ferrite core) 1 and powder of borosilicate zinc glass (two to five percent by weight of the ferrite core 1) are put in a rotary drum and mixed therein for one hour under a temperature of 870° C. The borosilicate zinc glass melts and sticks to the surface of the ferrite core 1. Further, the borosilicate zinc glass permeates into the ferrite core 1, and a glass coating 9 is formed on the ferrite core 1. Although no limits are set, the glass coating 9 has a thickness preferably within a range from 10 μm to 100 μm. An input electrode 7 and an output electrode 8 are formed on the glass-coated ferrite core 1 at the right and left sides of the flange 3.

A coil 10 is wound around the body 2 of the ferrite core 1, and ends 10*a* and 10*b* of the coil 10 are connected to the input electrode 7 and the output electrode 8 respectively by thermocompression bonding. The coil 10 is a copper wire with an insulating coating. In this way, a tip inductor which has a glass-coated ferrite core is produced.

Now, the function of the glass coating 9 on the ferrite core 1 is described.

When a tip inductor is soldered to a printed circuit board or the like, a flux sticks to the ferrite core. When this happens to a conventional inductor, $RCOOH^-$ of the flux combines with $BiO_2$ or PbO of the ferrite core, and Bi or PbO is precipitated. Thereby, the insulation resistance of the ferrite core is lowered. As for the inductor according to the present invention, however, because of the glass coating 9, the flux is not directly in contact with the ferrite core 1. Therefore, the low-temperature-sintered metal contained in the ferrite core 1 is not reduced.

Further, a high-temperature humidity test of the tip inductor with the glass-coated ferrite core was conducted to examine the function of the glass coating 9.

The initial quality factors of samples of the embodiment at a frequency of 100 MHz were measured, and each of the samples was soldered to a printed circuit board. With the residual flux uncleaned, the samples were set in a high-temperature humidity test vessel. In Experiment 1, the samples were exposed to a temperature of 70° C. and a relative humidity of 954 for 250 hours. In Experiment 2, the samples were exposed to a temperature of 120° C. and a relative humidity of 100% for 250 hours. Thereafter, the quality factors of the samples at a frequency of 100 MHz were measured. As for most of the samples, the quality factor did not change before and after the high-temperature humidity test.

For comparison, samples of prior art which have an uncoated ferrite core were subjected to the same high-temperature humidity test. In about forty to fifty percent of the samples, the quality factor changed before and after the high-temperature humidity test.

Furthermore, a pressure cooker test was conducted. In the pressure cooker test, samples of the embodiment were exposed to a temperature of 121° C. and a pressure of two normal atmospheres. With respect to each sample, the initial quality factor at a frequency of 100 MHz and the quality factor after the test at the same frequency were compared, and the rate of change of the quality factor was figured out. Samples of prior art were also subjected to the same test. Table 1 shows the result.

TABLE 1

| | Inductors of Present Invention | Inductors of Prior Art |
|---|---|---|
| Average of Rate of Change | −1% | −62% |
| Standard Deviation | 2 | 5 |
| Maximum of Rate of Change | −4.6% | −73.4% |
| Minimum of Rate of Change | 2.6% | −53.7% |

As is apparent from Table 1, the quality factor of an inductor of prior art which has an uncoated ferrite core changes at a rate of −624% on average. On the other hand, the quality factor of an inductor of the embodiment which has a glass-coated ferrite core hardly changes.

The glass coating of the ferrite core can be formed by printing. It is possible to provide the glass coating only on the portion of the ferrite core which is possibly in contact with a flux.

The main constituents of ferrite may be any other substances. For example, the ferrite may contain at least one of Mn, Fe, Co and Ni.

Although the present invention has been described in connection with the preferred embodiment, it is to be noted that various changes and modifications are possible to those who are skilled in the art. Such changes and modifications are to be understood as being within the scope of the present invention.

What is claimed is:

1. An inductor comprising:

a ferrite core which includes low-temperature-sintered $BiO_2$ and/or PbO, the ferrite core having a body and flange;

a glass coating on the ferrite core, the glass coating covering at least a portion which is in contact with a flux in soldering; and a conductive coil which is wound around the body of the ferrite core.

2. An inductor as claimed in claim 1, wherein the ferrite core includes at least one of Mn, Fe, Co, and Ni.

3. An inductor as claimed in claim 1 wherein the ferrite core includes mainly Ni, Zn, $Fe_2O_3$.

4. An inductor as claimed in claim 1, wherein the glass coating is borosilicate zinc or borosilicate lead.

5. Method for producing an inductor comprising the steps of:

adding a low-temperature sintered $BiO_2$ and/or PbO to ferrite powder;

mixing the low-temperature sintered $BiO_2$ and/or PbO with the ferrite powder;

compression molding the mixed low-temperature sintered $BiO_2$ and/or PbO and ferrite powder into a ferrite core having a body and a flange;

sintering the ferrite core;

forming a glass coating on the sintered ferrite core, the glass coating covering at least a portion of the ferrite core which is to contact solder flux; and winding a conductive coil around the body of the ferrite core.

* * * * *